US011145152B2

(12) United States Patent
Schwartz

(10) Patent No.: US 11,145,152 B2
(45) Date of Patent: Oct. 12, 2021

(54) BILL-LOADING MACHINE

(71) Applicant: Global Payments Gaming Services Inc., Las Vegas, NV (US)

(72) Inventor: Andrew J. Schwartz, Las Vegas, NV (US)

(73) Assignee: Global Payments Gaming Services Inc., Las Vegas, NV (US)

( * ) Notice: Subject to any disclaimer, the term of this patent is extended or adjusted under 35 U.S.C. 154(b) by 23 days.

(21) Appl. No.: 16/293,974

(22) Filed: Mar. 6, 2019

(65) Prior Publication Data

US 2019/0279454 A1 Sep. 12, 2019

Related U.S. Application Data

(60) Provisional application No. 62/640,636, filed on Mar. 9, 2018.

(51) Int. Cl.
*G07D 11/13* (2019.01)
*G07F 19/00* (2006.01)

(52) U.S. Cl.
CPC ..... *G07D 11/13* (2019.01); *G07F 19/203* (2013.01); *G07F 19/205* (2013.01); *G07D 2211/00* (2013.01)

(58) Field of Classification Search
CPC ..... G07D 11/28; G07D 11/50; G07D 11/40; G07D 11/13; G07D 2211/00; G07F 19/203; G07F 19/205
See application file for complete search history.

(56) References Cited

U.S. PATENT DOCUMENTS 4,321,672 A * 3/1982 Braun ..... G06Q 20/04 235/379
4,459,052 A * 7/1984 Lundblad ..... G07D 11/10 400/624
4,928,230 A * 5/1990 Kawamura ..... G07D 11/237 700/244
5,247,159 A * 9/1993 Yuge ..... G07D 11/34 235/379
5,984,177 A * 11/1999 Do ..... G07F 19/205 235/379
6,264,101 B1 * 7/2001 Ryan ..... G07D 11/30 235/379

(Continued)

*Primary Examiner* — Thien M Le
*Assistant Examiner* — Asifa Habib
(74) *Attorney, Agent, or Firm* — Mendelsohn Dunleavy. P.C.; Steve Mendelsohn

(57) ABSTRACT

A bill-loading machine for receptacles (e.g., cash cassettes or cash cartridges for cash cassettes) for cash-dispensing machines. The bill-loading machine has receptacle ports, currency bins, and bill dispensers. Each receptacle port receives a receptacle that (i) stores bills and (ii) is configurable to the cash-dispensing machines for dispensing the bills. Each currency bin stores a bills, and each bill dispenser loads a receptacle located at a corresponding receptacle port with bills from a corresponding currency bin. In some embodiments, the bill-loading machine includes a bill sorter that receives an input supply of bills of varied denominations, automatically sorts the bills into multiple flows of paper currency of specific denominations for storage in multiple currency bins, and automatically loads each currency bin with the bills of a corresponding denomination.

13 Claims, 1 Drawing Sheet

(56) References Cited

U.S. PATENT DOCUMENTS

| | | | | |
|---|---|---|---|---|
| 6,378,770 | B1 * | 4/2002 | Clark | G07D 11/245 235/379 |
| 6,510,985 | B1 * | 1/2003 | Clark | G07D 11/23 271/3.17 |
| 6,540,136 | B1 * | 4/2003 | Ross | G07D 11/50 235/379 |
| 8,893,959 | B1 * | 11/2014 | Graef | B65H 29/70 235/379 |
| 8,898,462 | B2 * | 11/2014 | Krummel | G07F 19/20 713/168 |
| 10,049,525 | B2 | 8/2018 | Schwartz | |
| 2002/0053594 | A1 | 5/2002 | Haney et al. | |
| 2004/0236691 | A1 * | 11/2004 | Force | G07D 11/26 705/43 |
| 2007/0034680 | A1 * | 2/2007 | Gomes | G07F 19/211 235/379 |
| 2010/0288831 | A1 | 11/2010 | Graef et al. | |
| 2014/0083814 | A1 * | 3/2014 | Nomura | G07D 11/17 194/206 |
| 2014/0263619 | A1 * | 9/2014 | Turocy | G07D 11/28 235/379 |
| 2015/0363991 | A1 * | 12/2015 | Yoon | B65H 29/001 700/232 |
| 2016/0163145 | A1 * | 6/2016 | Tamahashi | B65H 29/001 700/232 |
| 2017/0304870 | A1 * | 10/2017 | Takahama | B65H 43/00 |
| 2018/0197157 | A1 * | 7/2018 | Magee | G06Q 20/1085 |

* cited by examiner

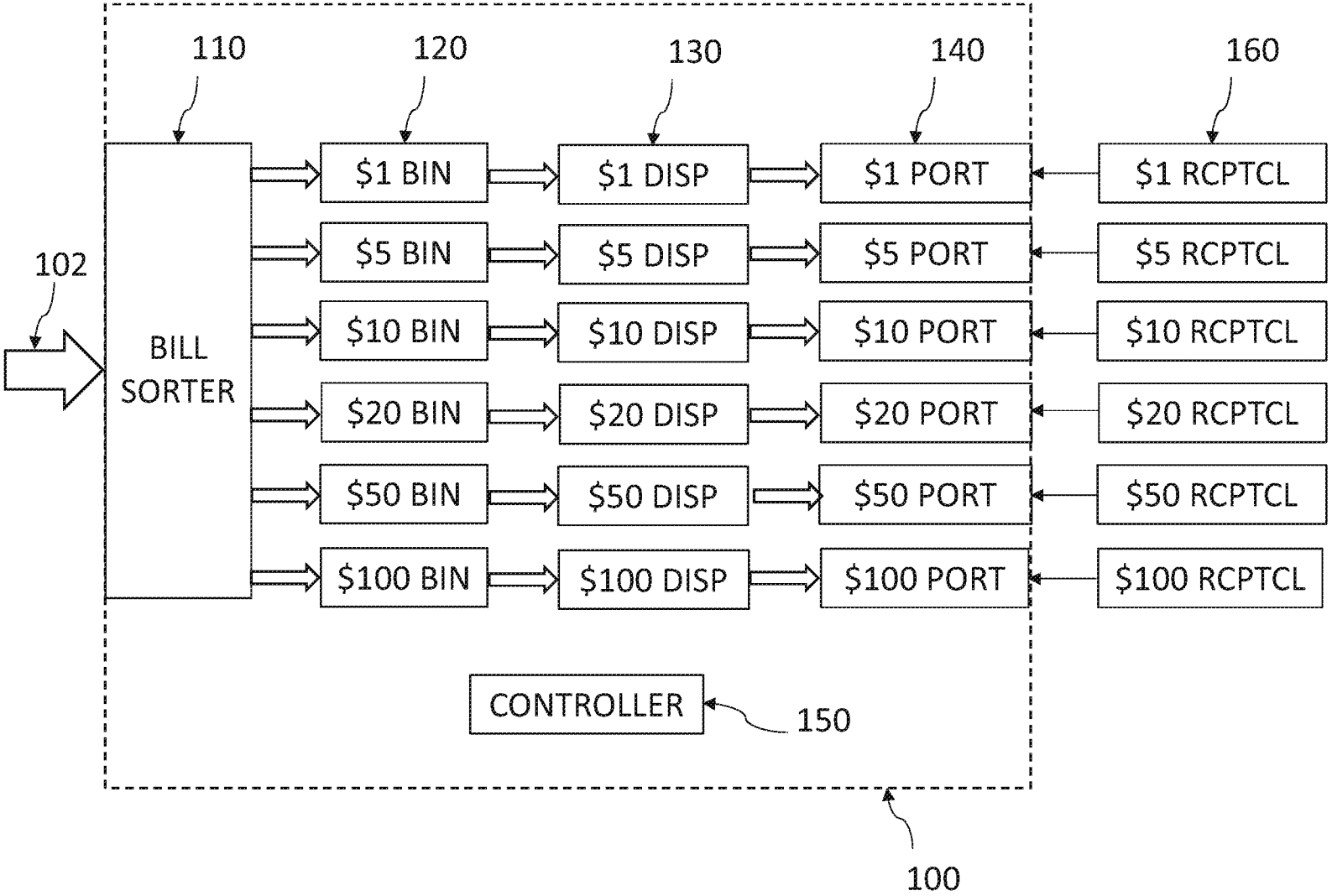
160
$1 RCPTCL
$5 RCPTCL
$10 RCPTCL
$20 RCPTCL
$50 RCPTCL
$100 RCPTCL
140
$1 PORT
$5 PORT
$10 PORT
$20 PORT
$50 PORT
$100 PORT
130
$1 DISP
$5 DISP
$10 DISP
$20 DISP
$50 DISP
$100 DISP
120
$1 BIN
$5 BIN
$10 BIN
$20 BIN
$50 BIN
$100 BIN
110
BILL SORTER
102
100
150
CONTROLLER

BILL-LOADING MACHINE

CROSS-REFERENCE TO RELATED APPLICATIONS

This application claims the benefit of the filing date of U.S. provisional application No. 62/640,636, filed on Mar. 9, 2018, the teachings of which are incorporated herein by reference in their entirety.

BACKGROUND

Field of the Invention

The present invention relates to cash-dispensing machines such as bank automated teller machines (ATMs), casino kiosks, and the like.

Description of the Related Art

This section introduces aspects that may help facilitate a better understanding of the invention. Accordingly, the statements of this section are to be read in this light and are not to be understood as admissions about what is prior art or what is not prior art.

A bank automated teller machine (ATM) is a type of cash-dispensing machine that contains a number of cash cassettes that store paper currency (i.e., bills or notes) to be dispensed to bank customers. A typical bank ATM machine may have 1-6 cash cassettes, each designed to hold up to a specified maximum number of twenty dollar bills to be dispensed to bank customers. ATM machines need to be serviced regularly to resupply the ATM machine with cash. Such service typically involves either (1) a service technician bringing already loaded cassettes to the location of the ATM machine to replace empty (or nearly empty) cassettes and returning with the replaced cassettes to be re-filled at another location or (2) a service technician bringing a supply of cash to the location of the ATM machine to re-fill empty (or nearly empty) cassettes on site for re-insertion into the ATM machine. An example of a conventional bank ATM machine is the Opteva ATM sold by Diebold of Green, Ohio.

A casino kiosk is another type of cash-dispensing machine that may also have a number of cash cassettes, each designed to hold up to a specified maximum number of bills to be dispensed to casino customers. One difference between a typical casino kiosk and a typical bank ATM machine is that the casino kiosk may have a larger number of cassettes that are used to dispense a number of different denominations of bills, where each different cassette is used for a specific denomination. Here, too, casino kiosks need to be regularly serviced to either replace or refill empty (or nearly empty) cassettes. An example of a conventional casino kiosk is the Neo kiosk sold by NRT of Toronto, Ontario, Canada.

Another type of machine typically used by both banks and casinos is the bill sorter. A bill sorter is able to receive an input supply of paper currency comprising bills of different denominations and automatically sort that input supply into multiple output flows of paper currency, where each output flow is of a different denomination. Such a bill sorter has electro-mechanical systems that are designed to extract each bill from the input supply, determine the denomination of that bill, and route it to the appropriate output flow. An example of a conventional bill sorter is the JetScan MPX 8200 bill sorter sold by Cummins Allison of Chicago, Ill.

BRIEF DESCRIPTION OF THE DRAWINGS

Embodiments of the invention will become more fully apparent from the following detailed description, the appended claims, and the accompanying drawings in which like reference numerals identify similar or identical elements.

FIG. 1 is a schematic block diagram of a bill-loading machine according to one embodiment of the invention.

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the FIGURES. For example, two FIGURES shown in succession may in fact be executed substantially concurrently or may sometimes be executed in the reverse order, depending upon the functionality/acts involved.

The task of manually filling and re-filling cash cassettes for cash-dispensing machines with bills is both labor intensive and subject to error. A service technician may place the wrong denomination of bills into a cassette. Individual bills may get torn or folded in the loading process, which can result in errors when the ATM machine or kiosk subsequently dispenses bills from the cassette.

To address these and other issues, the present invention is directed to a bill-loading machine that automatically loads bills into appropriate receptacles for use in cash-dispensing machines. The loading machine is programmed or otherwise configured to receive one or more receptacles and then automatically load those one or more receptacles with appropriate numbers of bills of appropriate denominations.

In certain embodiments, the receptacles are the cash cassettes themselves, and the loading machine is designed to receive one or more cash cassettes and then load those cash cassettes with appropriate numbers of bills of appropriate denominations. Note that, in certain embodiments, the cash cassettes are smart cassettes such as those described in U.S. patent application Ser. No. 15/480,516, filed on Apr. 6, 2017, the teachings of which are incorporated herein by reference. Such a smart cassette has electronics that keep track of the number of bills currently stored in the smart cassette. Such a smart cassette is able to communicate with the loading machine to inform the loading machine of (i) the specific denomination for which the smart cassette is configured and (ii) the number of bills currently stored in the smart cassette and/or the number of bills to be loaded into the smart cassette. In this way, the loading machine can re-load a smart cassette.

In certain other embodiments, the receptacles are cash cartridges, where each cash cartridge is designed to hold up to a specified number of bills and be inserted into or otherwise configured with a cash cassette, such that, after the cartridge-loaded cassette is inserted into a cash-dispensing machine, the cash-dispensing machine is able to dispense cash held in the cartridge within the cassette. In certain implementations, a single cartridge design is able to be used with cassettes having different designs from different cassette manufacturers.

In a typical implementation with either the cassette receptacles or cartridge receptacles, the loading machine is stationary, and service technicians will bring the receptacles to the loading machine to be re-filled. Note that, for the cartridge receptacles, the cassettes do not need to be transported from the site of the corresponding cash-dispensing machine. Instead, already-filled cartridges can be brought to a cash-dispensing machine having a number of cash cassettes, the empty (or nearly empty) cartridges can be removed from the cassettes and replaced with already-filled cartridges, and the removed cartridges can be returned to the location of the loading machine for reloading the cartridges with bills. This reduces the number of cassettes needed, since each cassette can always stay with its associated cash-dispensing machine. This also avoids having to transport the cassettes, thereby reducing the risk of damaging the sometimes fragile, relatively expensive cassettes.

Note that the loading machine's mechanism for loading a receptacle with bills is analogous to the mechanism for dispensing bills from a conventional smart cassette, but configured to operate in reverse. Like the bill-dispensing mechanism of a smart cassette, in certain embodiments, the loading machine's bill-loading mechanism is designed to identify the denomination of each bill and inform the loading machine's controller when a bill of the wrong denomination is detected. Such a bill-loading mechanism may also be able to detect and notify the loading machine's controller of torn or folded bills.

Depending on the implementation, the loading machine may be able to (i) receive and refill one receptacle at a time or (ii) receive and refill multiple receptacles at a time, either of the same denomination or of different denominations.

In certain embodiments, the loading machine is designed with the functionality of a conventional bill sorter. These embodiments are able to receive an input supply of bills of varied denominations, automatically sort those bills into multiple flows of paper currency of specific denominations, and automatically load receptacles for cash-dispensing machines with appropriate numbers of bills of appropriate denominations.

FIG. 1 is a schematic block diagram of a bill-loading machine 100 according to one embodiment of the invention. As shown in FIG. 1, the bill-loading machine 100 comprises a bill sorter 110, six currency bins 120, six bill dispensers 130, and six receptacle ports 140, where each currency bin 120 stores bills of a different one of six different denominations, each receptacle port 140 is configured to receive a receptacle 160 (e.g., a cash cassette or a cash cartridge for a cash cassette, depending on the implementation of the bill-loading machine 100) for a corresponding denomination, and each bill dispenser 130 is configured to dispense bills from the corresponding currency bin 120 into the receptacle 160 located at the corresponding receptacle port 140.

In operation, a different receptacle 160 is inserted into each different receptacle port 140 and an input supply 102 of cash is input to the bill sorter 110. The bill sorter 110 sorts the bills in the input supply 102 into their appropriate currency bins 120, and each bill dispenser 130 dispenses an appropriate number of bills into the corresponding receptacle 160.

The operations of the bill-loading machine 100 are controlled by a controller 150. In certain implementations where the receptacle ports 140 are designed to receive smart cassettes as the receptacles 160, the controller 150 is capable of communicating with each smart cassette to verify the denomination of currency for the smart cassette as well as the number of bills currently stored in the smart cassette in order to determine how many additional bills need to be loaded into the smart cassette.

Although the bill-loading machine 100 has one component set consisting of one currency bin 120, one bill dispenser 130, and one receptacle port 140 for each of six different denominations, the invention is not so limited. Other bill-loading machines of the invention may have more or fewer component sets. Furthermore, in some implementations, a bill dispenser may have multiple component sets of currency bins 120, bill dispensers 130, and receptacle ports 140 for particular denominations. For example, for receptacles 160 for bank ATM machines, all of the component sets of a bill-loading machine may be used exclusively for $20 bills. Such a bill-loading machine might be implemented without a bill sorter 110. Even a bill-loading machine for receptacles 160 for casino kiosks may have multiple component sets configured for $20 bills and/or $100 bills, while having only one component set for each of the other supported denominations.

In one embodiment, the invention is a bill-loading machine for receptacles for a cash-dispensing machine for dispensing cash to customers. The bill-loading machine comprises one or more receptacle ports, one or more currency bins, one or more bill dispensers, and a controller configured to control operations of the bill-loading machine. Each receptacle port is configured to receive a receptacle (i) configured to store bills and (ii) configurable to the cash-dispensing machine for dispensing the bills. Each currency bin configured to store a plurality of bills. Each bill dispenser configured to load a receptacle located at a corresponding receptacle port with bills from a corresponding currency bin.

In certain embodiments of the foregoing, the bill-loading machine comprises a plurality of receptacle ports configured to concurrently receive a plurality of receptacles; a plurality of currency bins configured to concurrently store bills; and a plurality of bill dispensers configured to concurrently load the plurality of receptacles with the bills stored in the plurality of currency bins.

In certain embodiments of the foregoing, the bill-loading machine is configured to concurrently load a first receptacle with bills of a first denomination and a second receptacle with bills of a second denomination different from the first denomination.

In certain embodiments of the foregoing, the bill-loading machine is configured to concurrently load a first receptacle with bills of a first denomination and a second receptacle with bills of the first denomination.

In certain embodiments of the foregoing, the receptacle is a cash cassette for the cash-dispensing machine.

In certain embodiments of the foregoing, the cash cassette is a smart cassette configured to keep track of a denomination of the cash cassette and a number of bills stored in the cash cassette; and the controller is configured to communicate with the cash cassette to receive information about the denomination of the cash cassette and the number of bills stored in the cash cassette.

In certain embodiments of the foregoing, the receptacle is a cartridge for a cash cassette for the cash-dispensing machine. The cartridge is removable from the cash cassette, configurable to a receptacle port of the bill-loading machine for loading the cartridge with bills, and then re-configurable to the cash cassette; and the cash cassette, having an empty cartridge, is removable from the cash-dispensing machine and, having a filled cartridge, is re-configurable to the cash-dispensing machine.

In certain embodiments of the foregoing, the bill-loading machine further comprises a bill sorter configured to receive an input supply of bills of varied denominations, automatically sort the bills into multiple flows of paper currency of specific denominations for storage in multiple currency bins, and automatically load each currency bin with the bills of a corresponding denomination.

In certain embodiments of the foregoing, each bill dispenser is configured to identify the denomination of each bill being loaded into the corresponding receptacle and inform the controller when a bill of an incorrect denomination is detected.

In certain embodiments of the foregoing, each bill dispenser is configured to detect and inform the controller of torn or folded bills.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of FIGURE numbers and/or FIGURE reference labels in the claims is intended to identify one or more possible embodiments of the claimed subject matter in order to facilitate the interpretation of the claims. Such use is not to be construed as necessarily limiting the scope of those claims to the embodiments shown in the corresponding FIGURES.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A bill-loading machine for receptacles for a cash-dispensing machine for dispensing cash to customers, the bill-loading machine comprising:

a plurality of receptacle ports configured to concurrently receive a plurality of removable receptacles, each receptacle port configured to receive a removable receptacle (i) configured to be refilled with bills of a single corresponding denomination and (ii) configurable to the cash-dispensing machine for dispensing the bills of the single corresponding denomination, wherein:

the bill-loading machine is configured to concurrently refill the plurality of removable receptacles with multiple different denominations of bills with each removable receptacle receiving bills of the single corresponding denomination;

each removable receptacle is either a cash cassette configured to be removed from the bill-loading machine and inserted into the cash-dispensing machine for dispensing bills of the single corresponding denomination from the cash-dispensing machine or a cartridge configured to be removed from the bill-loading machine and inserted into a cash cassette to be inserted into the cash-dispensing machine for dispensing bills of the single corresponding denomination from the cash-dispensing machine;

the cash-dispensing machine is an ATM or a kiosk;

the bill-loading machine is not an ATM or a kiosk; and the bill-loading machine is configured to re-fill cash cassettes or cartridges for cash cassettes to be inserted into multiple different ATMs or multiple different kiosks;

a plurality of non-removable currency bins configured to concurrently store bills of multiple different denominations, each non-removable currency bin configured to store a plurality of bills of a single corresponding denomination, wherein the non-removable currency bins are different from the removable receptacles;

a plurality of bill dispensers configured to concurrently refill the plurality of removable receptacles with the bills stored in the plurality of non-removable currency bins, each bill dispenser configured to refill a removable receptacle located at a corresponding receptacle port with bills of a single corresponding denomination from a corresponding non-removable currency bin;

a bill sorter configured to receive an input supply of bills of varied denominations, automatically sort the bills into multiple flows of paper currency of specific denominations for storage in the plurality of non-removable currency bins, and automatically load each non-removable currency bin with the bills of the single corresponding denomination; and a controller configured to control operations of the bill-loading machine.

2. The bill-loading machine of claim 1, wherein the bill-loading machine is configured to concurrently load a first receptacle of the plurality of receptacles with bills of a first denomination and a second receptacle of the plurality of receptacles with bills of a second denomination different from the first denomination.

3. The bill-loading machine of claim 1, wherein the bill-loading machine is configured to concurrently load a first receptacle of the plurality of receptacles with bills of a first denomination and a second receptacle of the plurality of receptacles with bills of the first denomination.

4. The bill-loading machine of claim 1, wherein each receptacle is a cash cassette for the cash-dispensing machine.

5. The bill-loading machine of claim 4, wherein:

the cash cassette is a smart cassette configured to keep track of a denomination of the cash cassette and a number of bills stored in the cash cassette; and the controller is configured to communicate with the cash cassette to receive information about the denomination of the cash cassette and the number of bills stored in the cash cassette.

6. The bill-loading machine of claim 1, wherein each receptacle is a cartridge for a cash cassette for the cash-dispensing machine, wherein:

the cartridge is removable from the cash cassette, configurable to a receptacle port of the bill-loading machine for loading the cartridge with bills, and then re-configurable to the cash cassette; and the cash cassette, having an empty cartridge, is removable from the cash-dispensing machine and, having a filled cartridge, is re-configurable to the cash-dispensing machine.

7. The bill-loading machine of claim 1, wherein each bill dispenser is configured to identify the denomination of each bill being loaded into the corresponding receptacle and inform the controller when a bill of an incorrect denomination is detected.

8. The bill-loading machine of claim 7, wherein each bill dispenser is configured to detect and inform the controller of torn or folded bills.

9. The bill-loading machine of claim 1, further comprising:

a bill sorter configured to receive an input supply of bills of varied denominations, automatically sort the bills into multiple flows of paper currency of specific denominations for storage in multiple currency bins, and automatically load each currency bin with the bills of a corresponding denomination, wherein:

the bill-loading machine is configured to concurrently load a first receptacle with bills of a first denomination and a second receptacle with bills of a second denomination different from the first denomination;

each bill dispenser is configured to identify the denomination of each bill being loaded into the corresponding receptacle and inform the controller when a bill of an incorrect denomination is detected; and each bill dispenser is configured to detect and inform the controller of torn or folded bills.

10. The bill-loading machine of claim 9, wherein the bill-loading machine is configured to concurrently load a first receptacle with bills of a first denomination and a second receptacle with bills of the first denomination.

11. The bill-loading machine of claim 9, wherein the receptacle is a cash cassette for the cash-dispensing machine.

12. The bill-loading machine of claim 11, wherein:

the cash cassette is a smart cassette configured to keep track of a denomination of the cash cassette and a number of bills stored in the cash cassette; and the controller is configured to communicate with the cash cassette to receive information about the denomination of the cash cassette and the number of bills stored in the cash cassette.

13. The bill-loading machine of claim 9, wherein the receptacle is a cartridge for a cash cassette for the cash-dispensing machine, wherein:

the cartridge is removable from the cash cassette, configurable to a receptacle port of the bill-loading machine for loading the cartridge with bills, and then re-configurable to the cash cassette; and the cash cassette, having an empty cartridge, is removable from the cash-dispensing machine and, having a filled cartridge, is re-configurable to the cash-dispensing machine.

* * * * *